US005845649A

United States Patent [19]

Saito et al.

[11] Patent Number: 5,845,649

[45] Date of Patent: Dec. 8, 1998

[54] FLAVOR-TASTING ARTICLE

[75] Inventors: Yutaka Saito; Yuriko Anzai; Ryuichi Suzuki; Hiroshi Ichinose, all of Yokohama, Japan

[73] Assignee: Japan Tobacco Inc., Tokyo, Japan

[21] Appl. No.: 925,134

[22] Filed: Sep. 8, 1997

Related U.S. Application Data

[63] Continuation of Ser. No. 530,104, Sep. 26, 1995, abandoned.

[30] Foreign Application Priority Data

Jan. 26, 1994 [JP] Japan ..... 6-007066

[51] Int. Cl.[6] ..... A24D 1/18; A24B 15/16

[52] U.S. Cl. ..... 131/352; 131/194; 131/274

[58] Field of Search ..... 131/194, 274, 131/279, 352, 359; 239/53; 426/97, 98, 99; 424/443

[56] References Cited

U.S. PATENT DOCUMENTS

| | | | |
|---|---|---|---|
| 4,109,663 | 8/1978 | Maeda et al. . | |
| 4,774,093 | 9/1988 | Provonchee et al. | 424/493 |
| 4,941,483 | 7/1990 | Ridings et al. | 131/194 |
| 5,247,947 | 9/1993 | Clearman et al. | 131/194 |
| 5,249,586 | 10/1993 | Morgan et al. | 131/194 |
| 5,525,367 | 6/1996 | King et al. . | |
| 5,543,162 | 8/1996 | Timonen et al. . | |

FOREIGN PATENT DOCUMENTS

| | | |
|---|---|---|
| 0509657 | 10/1992 | European Pat. Off. . |
| 51-128500 | 11/1976 | Japan . |
| 53-104742 | 9/1978 | Japan . |
| 59-32108 | 8/1984 | Japan . |
| 59-41397 | 10/1984 | Japan . |
| 59-41398 | 10/1984 | Japan . |
| 60-14761 | 4/1985 | Japan . |
| 1-191674 | 8/1989 | Japan . |
| 1-289457 | 11/1989 | Japan . |
| 2-190171 | 7/1990 | Japan . |
| 5-115272 | 5/1993 | Japan . |

OTHER PUBLICATIONS

Derwent Publications Ltd., London, GB; AN 79–01094b (Abstract) and JP–A–53 133 697 (Japan Tobacco & Salt Ltd.) (1978) (Abstract).

*Primary Examiner*—Stanley S. Silverman
*Assistant Examiner*—Steven B. Leavitt
*Attorney, Agent, or Firm*—Birch, Stewart, Kolasch & Birch, LLP

[57] ABSTRACT

A flavor-tasting article including a flavor-generating medium, and a heating source disposed physically separated from the flavor-generating medium to heat the flavor-generating medium to release a flavoring component therefrom. The flavor-generating medium includes a flavoring component-holding material formed of a heat-irreversibly gelled, heat-irreversibly coagulating glucan and a flavoring component held in the holding material. The flavor-generating material releases a sufficient amount of the flavoring component only through heating.

28 Claims, 2 Drawing Sheets

FLAVOR-TASTING ARTICLE

This application is a continuation of application Ser. No. 08/530,104 filed on Sep. 26, 1995, now abandoned.

TECHNICAL FIELD

The present invention relates to a flavor-tasting article, and more particularly to a flavor-tasting article in which a heating source and a flavor-generating portion are physically separated from each other.

BACKGROUND ART

By burning tobacco is a representative flavor-generating material can be tasted through gustatory or olfactory organs of human.

Recently, flavor-generating materials have been developed, in place of tobacco, in which a flavoring component is held in a suitable substrate, and the flavor generated therefrom upon heating, etc. is tasted. See, for example, Unexamined Japanese Patent Application Publications 5-103836 (cigarette), 5-115272 (flavor-generating article) and 5-199860 (Mixture and articles for stimulating the gustatory organs, and method of manufacturing thereof).

However, the flavor-tasting articles containing the conventional flavor-generating material are accompanied with a problem that the flavoring component contained therein is not sufficiently released immediately from the first puffing even if the flavor-generating material is heated. Further, the conventional flavor-generating materials are also defective in that the storage stability of the flavoring component is so poor that when the flavor-tasting articles containing the conventional flavor-generating material are stored for a long period of time, the flavoring component will vanish through vaporization and at the same time the flavor-tasting articles tend to become difficult to provide a stabilized generation of flavor during smoking. Meanwhile, it is necessary that the flavor-generating material does not generate an obnoxious taste and smell when it is heated. It is also desirable for the flavor-generating material and the flavor-tasting article to be capable of generating a flavor only through heating.

SUMMARY OF THE INVENTION

An object of the present invention is to provide a flavor-tasting article in which a heating source and a flavor-generating portion are physically separated from each other and which contains a flavor-generating material excellent in storage stability of the flavoring component contained therein and is capable of readily releasing the flavoring component when it is heated, without giving off any obnoxious taste and smell.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DISCLOSURE OF THE INVENTION

In order to achieve the above object, a heat-irreversible coagulating glucan which has been heat-irreversibly gelled is used in the present invention as a holding material for holding the flavoring component. The flavor-generating material comprising this heat-irreversibly gel of the glucan is capable of firmly fixing and retaining the flavoring component under the normal storage conditions, and of readily releasing a sufficient amount of the flavoring component when it is heated, without requiring burning of the material (i.e., it generates a sufficient amount of flavoring component only if heated: the generation of the flavor). In addition, the flavor-generating material of the invention does not generate any obnoxious taste or smell when it is heated.

Namely, according to the present invention, there is provided a flavor-tasting article comprising a flavor-generating medium which comprises a flavor-generating material composed of a flavoring component-holding material formed of a heat-irreversibly gelled heat-irreversibly coagulating glucan, and a flavoring component held in the holding material, and which is capable of releasing a sufficient amount of the flavoring component only through heating; and a heating source which is physically separated from the flavor-generating medium, and is used for heating the flavor-generating medium to release the flavoring component therefrom.

BRIEF DESCRIPTION OF THE DRAWINGS

The present invention will become more fully understood from the detailed description given hereinbelow and the accompanying drawings which are given by way of illustration only, and thus are not limitative of the present invention.

BEST MODE FOR CARRYING OUT THE INVENTION

Figure 1:
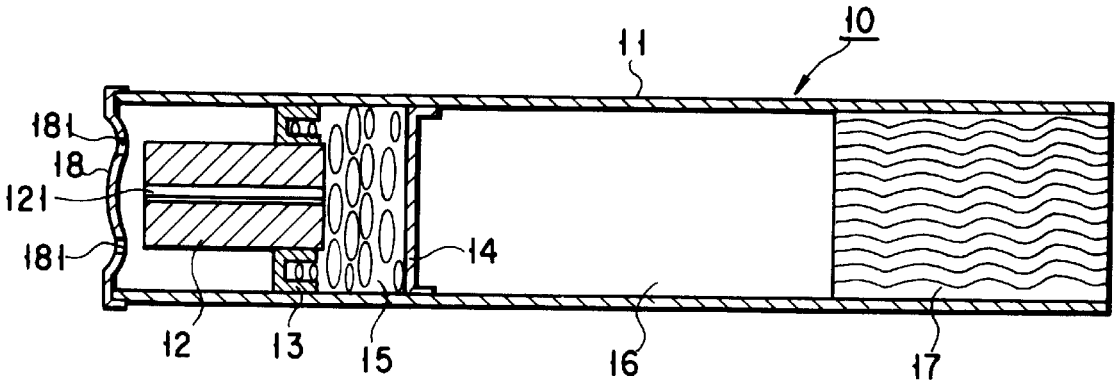
FIG. 1 is a sectional view schematically showing one example of a flavor-tasting article to which the present invention may be applied.

The present inventors have conducted extensive studies in an attempt to develop a flavor-tasting article which is excellent in retention stability of a flavoring component in the ordinary storage conditions and capable of readily releasing the flavoring component upon being heated, without accompanying the generation of obnoxious taste and smell. As a result, it has been found that the object can be achieved by the use of a heat-irreversible gel of a heat-irreversibly coagulating glucan such as β-1,3-glucan, for example, curdlan, as a holding material for the flavoring component.

The glucan used in the present invention is known per se in the art. For example, curdlan, which is most preferably used in the present invention, is a straight-chain β-1,3-glucan wherein about 400 to 500 D-glucose molecules are linked together through β-glucosidic linkage at 1-3 position, and is insoluble in water and in most of organic solvents. Moreover, the glucan is safe to human beings (for example, Unexamined Japanese Patent Application Publication 1-289457 discloses preparing an edible film by mixing β-1,3-glucan such as curdlan with a water-soluble high molecular material). Glucan such as curdlan is commercially available, usually in the form of powder.

When β-1,3-glucan, in the form of a dispersion in water, is heated above the critical gelation temperature thereof (in the case of curdlan, 80° C. or more), it is gelled. The resultant gel will never be melted again even if it is heated again (heat-irreversible gel).

The present inventors have found out that such a heat-irreversible gel of a heat-irreversibly coagulating glucan, such as β-1,3-glucan, is capable of firmly holding and retaining flavoring components therein, but capable of readily releasing the flavoring components as it is heated, without generating substances during heating, which adversely affect the released flavor, such as obnoxious stimulating, pungent or fibrous smelling substances.

The flavoring component used in the flavor-generating material of the invention is preferably liquid or solid (i.e., not gaseous) at a temperature at which the aqueous dispersion of a heat-irreversibly coagulating glucan is prepared, which will be described later. There is particularly no restriction as to the kind of flavoring component used, as far as its flavor can satisfy the taste of human through its gustatory or olfactory organs. Any hydrophilic or hydrophobic flavoring components may be used. Examples of hydrophilic flavoring component are leaf tobacco extract, natural plant extract (for example, licorice extract, Saint-John's bread extract, plum extract, peach extract and the like), acids (for example, malic acid, tartaric acid, citric acid and the like), saccharides (for example, glucose, fructose, isomerized sugar and the like), and nicotine salts (for example, nicotine citrate and the like). Examples of hydrophobic flavoring component are tobacco powder, menthol, cocoas (powder, extract and the like), esters (for example, iso-amyl acetate, linalyl acetate, iso-amyl propionate, linalyl butyrate and the like), natural essential oils (plant essential oils such as vanilla extract, spearmint, peppermint, cassia, jasmine; and animal essential oils such as musk, amber, civet, castoreum and the like), and single incense (for example, anethole, limonene, linalol, eugenol and the like). These flavoring components may be employed singly or in combination of two or more of these.

The flavoring components may be used at any concentration in the flavor-generating material of the invention sufficient to satisfy the taste of human through its gustatory or olfactory organs as the flavor-generating material is heated, and the concentration can be arbitrarily adjusted. More specifically, the flavoring component is present in an amount from a trace amount to 20% by weight, and preferably from 5 to 10% by weight in the final flavor-generating material.

In the preparation of the flavor-generating material of the present invention, it is preferred that a flavoring component is added to an ungelled glucan such as curdlan before the ungelled glucan is subjected to gelation, and then the resultant formulation is subjected to the thermal gelation of the glucan. Namely, it has been found that when a flavoring component is added to the glucan prior to the gelation of the glucan, and then the glucan is thermally gelled, the flavoring component can be incorporated or entrapped within the three-dimensional network of the glucan molecules to be firmly fixed and held therein, so that the retention of the flavoring component can be enhanced and the durability of release of the flavoring component during heating can be remarkably enhanced.

More specifically, a glucan, usually in the form of powder, is first stirred in water at a high speed to obtain a dispersion (glucan slurry). The preparation of this dispersion is preferably performed by stirring the glucan with a mixer at a temperature of 20° to 30° C. A stable aqueous dispersion of glucan can be obtained in this manner. When the content of glucan such as curdlan is large, a slurry of high viscosity will result, thus making it more difficult to obtain a slurry which is easy to handle. In particular, when the flavor-generating material is to be prepared in the form of sheet, the content of glucan, in particular curdlan, in an aqueous dispersion, should preferably be 1 to 20% by weight, more preferably be 3 to 5% by weight.

A desired flavoring component is then added at a desired ratio to the thus prepared aqueous dispersion of glucan, and mixed therein. In this case, if the flavoring component employed is hydrophobic, the hydrophobic component should preferably be preliminarily dissolved in an oily solvent (for example, plant oils or saturated fatty acid triglyceride), preferably together with an emulsifying agent which is known as a food additive (for example, glycerol fatty acid ester, sucrose fatty acid ester, sorbitan fatty acid ester, propylene glycol fatty acid ester and lecithin), to prepare a dissolution material, which is then mixed with the aqueous dispersion of glucan. The resultant mixture is then dispersed and emulsified through a high speed stirring as mentioned above. Among the above-mentioned oily solvents for hydrophobic flavoring components, a middle chain saturated fatty acid triglyceride (MCT) is particularly suited for use, since this substance is capable of readily dissolving most of hydrophobic flavoring components, excellent in oxidation stability as it does not contain unsaturated fatty acid components, and easy to handle owing to its low viscosity. Further, the use of emulsifying agent is effective in forming a satisfactory emulsion wherein the flavoring component is uniformly dispersed and retained therein.

In preparation of the above-mentioned dissolution material, a hydrophilic flavoring component may also be added thereto. In such a case, the hydrophobic flavoring component is dissolved in the oily solvent, and stabilized as a minute emulsion by means of a high speed stirring. On the other hand, the hydrophilic flavoring component is uniformly dispersed and stabilized in the aqueous dispersion of glucan of high-viscosity.

In order to impart a pliability to a resulting sheet, thereby facilitating peeling of the sheet from a casting support, it is preferable to add a softening agent comprising a polyhydric alcohol (for example, glycerin, propylene glycol) and/or a saccharide (for example, monosaccharides such as glucose and fructose; disaccharides such as maltose, saccharose and lactose; and polysaccharides such as cellulose and starch; and oxidation derivatives thereof such as aldonic acid and uronic acid) to the aqueous dispersion of glucan containing the flavoring component. By adjusting the ratio between the contents of polyhydric alcohols and saccharides, the softness of the resultant sheet can be adjusted.

The aqueous dispersion of glucan containing the flavoring component and other components, thus obtained, is then cast over a suitable casting support (such as a stainless steel belt) as a thin sheet after being subjected, if required, to a defaming treatment under a reduced pressure. This thin sheet is then heat-dried at a temperature which enables the glucan to be heat-irreversibly gelled (for example, 80° C. to 140° C. in the case of curdlan). With this heating treatment, the water content of the thin sheet is reduced down to, for example, 10%, and at the same time the glucan is transformed into a heat-irreversible gel firmly fixing and keeping therein the flavoring component, thus obtaining a flavor-generating material of the present invention. The above-mentioned gelation is achieved only through heating, without using any gelling agent at all. As mentioned above, glucan is subjected according to the present invention to heat-gelation in the form of an aqueous dispersion. When glucan is subjected to heat-gelation as the aqueous dispersion, the flavor of the flavoring component is not adversely affected, in contrast to the case where glucan is subjected to heat-gelation in the form of an aqueous alkaline solution.

The flavor-generating material of the invention which comprises a glucan gel holding the flavoring component therein, thus obtained, can be easily peeled off from the casting support. If required, this glucan gel may be humidified and conditioned when it is peeled from the support.

The flavor-generating material of the present invention hardly releases the flavoring component contained therein under the ordinary storage conditions (for example, at a temperature of 22° C. and under a relative humidity of 60%), but, if heated (for example, 200° to 300° C., or more), readily releases the flavoring component, without generating any obnoxious taste or smell during heating. Further, the flavor-generating material of the present invention is insoluble in water as well as in most of organic solvents, and unharmful.

The content of each component in the final flavor-generating material is preferably as follows:

The content of the glucan, in particular curdlan, ranges from 2 to 70% by weight, more preferably from 10 to 40% by weight. If the content of the glucan exceeds 70% by weight, the pliability of the resultant gel will tend to be lowered. On the other hand, if the content of the glucan is less than 2% by weight, an incomplete formation of gel will tend to be resulted.

The content of the oily solvent is 30% by weight or less, preferably 5 to 15% by weight. If the content of the oily solvent exceeds 30% by weight, it becomes impossible for the glucan gel to keep all of the oily solvent therein, so that some of the oily solvent will leak out of the glucan gel.

The content of the emulsifying agent is 30% by weight or less, preferably 5 to 15% by weight. If the content of the emulsifying agent exceeds 30% by weight, it becomes impossible for the glucan gel to keep all of the emulsifying agent therein, so that some of the emulsifying agent will leak out of the glucan gel as in the case of the oily solvent. Accordingly, it is preferable that the total of the oily solvent and emulsifying agent do not exceed 30% by weight. The optimum ratio between the oily solvent and emulsifying agent is 2:1.

The total amount of the polyhydric alcohol and saccharide is 50% by weight or less, more preferably 10 to 30% by weight (a saccharide serving also as a flavoring component can be used within this range).

The flavor-generating material of the present invention may be cut into fine pieces or pulverized into powder, providing a flavor-generating medium, optionally in combination with the other flavor-generating material such as cut tobacco.

Alternatively and preferably, the cut or pulverized flavor-generating material of the invention is kneaded in an ordinary sheet tobacco raw material and formed into a sheet, which is then cut into fine pieces, or pulverized with a hammer mill. The resultant material may be used singly or in combination with the other flavoring component (such as cut tobacco) to prepare a flavor-generating medium. A typical composition of the rolled sheet tobacco material containing the flavor-generating material of the invention comprises 100 parts by weight of tobacco powder (or cellulose or dolomite), 5 to 20 parts by weight of a reinforcing material (for example, tobacco fibers or pulp), 1 to 15 parts by weight of a binder (for example, carboxymethyl cellulose), 1 to 40 parts by weight, preferably 5 to 20 parts by weight of a flavor-generating material of the invention, and any required amount of water. This composition may optionally contain a suitable amount of a humectant (for example, glycerin) or a water-resistant agent (for example, glyoxal). The flavor-generating material of the invention may be kneaded into the other kinds of sheet tobacco such as a slurry sheet tobacco.

The flavor-generating medium of the present invention can be combined with a suitable heating source which heats, but does not substantially burn the medium, to fabricate a flavor-tasting article (a smoking article) of an ordinary cigarette type. Namely, the flavor-tasting article of the invention has a flavor generating medium comprising a flavor-generating material of the invention, and a heating source which is disposed physically separated from the medium, for heating the flavor-generating medium to release the flavoring component therefrom. As to the combination of a flavor-generating medium and a heating source, a reference may be made to Unexamined Japanese Patent Application Publications 2-84166; 2-190171; 2-191674; 5-103836; 5-115272 and 6-29647. The flavor-generating material of the present invention is capable of readily releasing the flavoring component as soon as it is heated by a heating source such as a carbonaceous combustible heating source, a chemical reaction heating source or an electrical heating source, to satisfy the taste of a smoker through his gustatory or olfactory organs.

FIG. 1 illustrates one embodiment of a non-burning type smoking article according to the present invention (the term "non-burning type" is intended herein to refer to an article whose flavor-generating material or medium per se is not burned). The basic structure of this non-burning type smoking article is already known in the art as disclosed in Unexamined Japanese Patent Application Publication 2-84166. Referring to FIG. 1, a smoking article 10 has a non-combustible, heat-insulating, porous hollow ceramic tube 11 and the interior of the tube 11 is partitioned into three sections. In a first section located at the distal end portion of the tube 11, a columnar carbonaceous heat source 12 formed of, for example, charcoal particles integrally bound together is disposed fittingly supported by a circular fitting member 13 disposed at approximately the center of the first section, and is spaced apart from the inner wall of the tube 11. The carbonaceous heat source 12 is provided with at least one longitudinal air passageway 121 extending through the central portion thereof. The first section is partitioned from a second section by a partition wall 14 which allows air to pass therethrough. In the first section, a space formed between the rear end of the heat source 12 and the partition wall 14 is filled with a flavor-generating medium 15 containing the cut or powdered flavor-generating material of the invention. The flavor-generating medium 15 may be composed solely of the flavor-generating material of the invention or of a combination of the flavor-generating material of the invention with any other suitable flavor-generating material (such as cut tobacco). In a third section located at the rear end portion of the tube 11, a filter 17 having a low filtration efficiency is inserted. A second section located between the first section and the third section is kept vacant. A cap 18 provided with a plurality of air-flow holes 181 may be detachably mounted to the distal opening of the first section. When the carbonaceous heat source 12 is lit, and suction is effected through the filter 17, the ambient air is forced to enter the air-flow holes 181 of the cap 18 and, passes through the air passageway 121 of the carbonaceous heat source 12, during which the air is heated by the lit carbonaceous heat source 12. The heated air heats the flavor-generating medium 15 to release the flavoring component therefrom. The air now entraining the flavoring component is formed into aerosol as it is passing through the vacant portion 16, and the flavor can be tasted through the filter 17.

Figure 2:
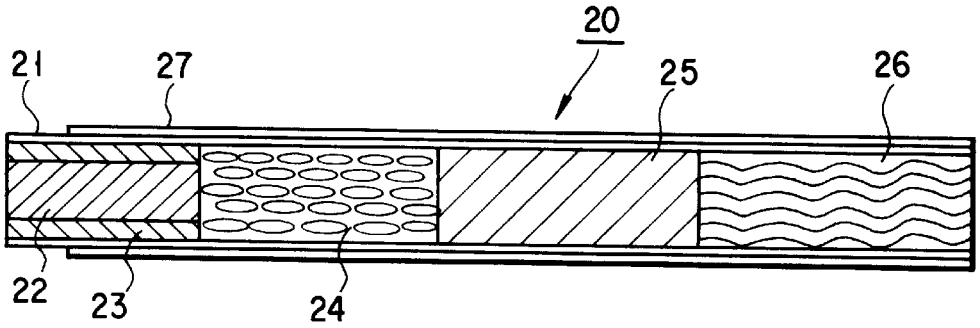
FIG. 2 is a sectional view schematically showing another example of a flavor-tasting article to which the present invention may be applied.

FIG. 2 illustrates another embodiment of a non-burning type smoking article according to the present invention. The basic structure of this non-burning type smoking article is already known in the art as disclosed in Unexamined Japanese Patent Application Publication 6-189733. Referring to FIG. 2, a smoking article 20 has a packaging member 21 (for example a laminate of paper and metal foil) formed into a hollow cylindrical body which may be formed of portions thereof. The interior of the packaging member 21 is partitioned into four sections. In a first section located at the distal end portion of the cylindrical packaging member 21, a heat-insulating cylindrical body 23 made of, for example, glass fibers is inserted, and holds therein a columnar carbonaceous heat source 22 provided on its outer surface with a plurality of grooves running longitudinally along the whole length thereof. The distal end of the heat-insulating cylindrical body 23 is projected out of the packaging member 21. A second section neighboring the first section is filled with a flavor-generating medium 24 containing a flavor-generating material of the invention. This flavor-generating medium 24 may contain a flavor-generating material of the invention kneaded into a sheet tobacco explained hereinabove. A third section neighboring the second section may be filled with cut tobacco 25. A fourth section neighboring the third section may be filled with a filter 26 of low filtering efficiency. The packaging member 21 may be wrapped around its outer wall with a paper material 27. When the carbonaceous heat source 22 is lit and the smoking article is sucked, the ambient air is forced to pass through the grooves formed on peripheral wall of the carbonaceous heat source 22 and is heated by the heat of the lit carbonaceous heat source 22. The heated air heats the flavor-generating medium 24 during passing therethrough to release the flavoring component therefrom. The air now entraining the flavoring component passes through the cut tobacco 25, if present, to takes up the flavor of the cut tobacco 25, and is tasted by a smoker through the filter 17.

Figure 3:
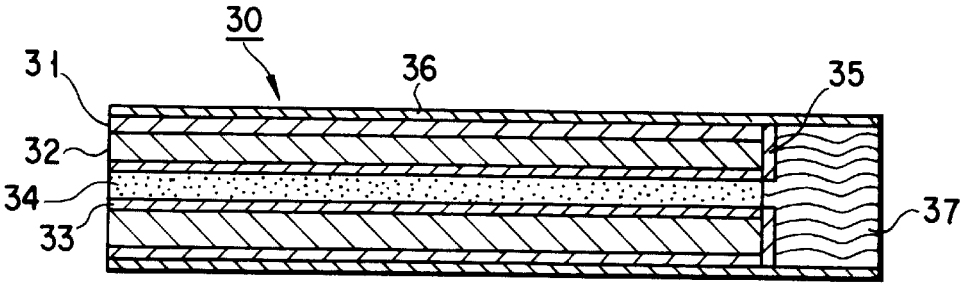
FIG. 3 is a sectional view schematically showing still another example of a flavor-tasting article to which the present invention may be applied.

FIG. 3 illustrates still another embodiment of a non-burning type smoking article according to the present invention. The basic structure of this non-burning type smoking article is already known in the art as disclosed in Unexamined Japanese Patent Application Publication 6-296479. Referring to FIG. 3, a smoking article 30 comprises a triple-tube structure wherein each of the tubes is coaxially disposed and contacted with each other. The outermost tube 31 is a fuel pipe and is formed of a molded body made of a combustible material containing carbon powders. The intermediate tube disposed on the inner wall of the fuel pipe 31 is a first heat-insulating pipe and formed of, for example, graphite felt. The innermost tube 33 is formed of, for example, alumina trihydrate and constitutes a second heat-insulating pipe, which may have an insulating property lower than that of the first heat-insulating pipe 32. Inside of this heat-insulating pipe 33, a flavor-generating medium 34 containing a flavor-generating material of the invention is filled. On the rear end surface of the triple-tube structure, an annular partition plate 35 which is impermeable to smoke is disposed. The fuel pipe 31 is wrapped with a cigarette wrapping material (wrapper) 36 in such a manner that the wrapper 36 is extended out beyond the rear end of the triple-tube structure, thereby forming a space defined by the rear end of the triple-tube structure and the wrapper 36. The space thus formed is filled with a filter 37 having a low filtering efficiency.

Figure 4:
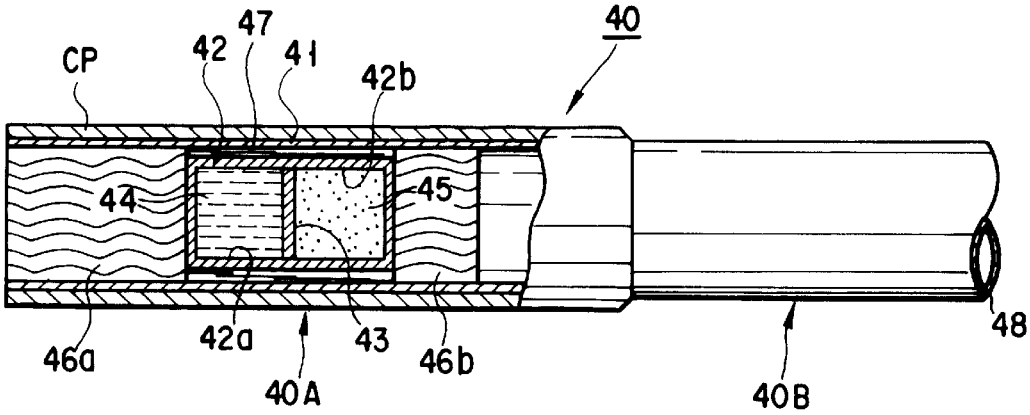
FIG. 4 is a partially sectional side view schematically showing still another example of a flavor-tasting article to which the present invention may be applied.

FIG. 4 illustrates still another embodiment of a non-burning type smoking article according to the present invention. The basic structure of this non-burning type smoking article is already known in the art as disclosed in Unexamined Japanese Patent Application Publication 1-191674. Referring to FIG. 4, a smoking article 40 has an external appearance similar to a filter-tipped cigarette, and comprises a hollow cylindrical filter unit 40A resembling the filter portion of a filter-tipped cigarette and a cigarette cylinder 40B resembling the cigarette portion of a filter-tipped cigarette. These filter unit 40A and cigarette cylinder 40B are connected to each other by a tip paper CP as in the case of the ordinary filter-tipped cigarette. The cigarette cylinder 40B comprises a plastic pipe member 48, and the end portion of the cigarette cylinder 40B which is remote from the cylindrical filter unit 40A is adapted to be clogged with an air-permeable clogging member (not shown) which simulates leaf tobacco, for example. The filter unit 40A has a deformable hollow cylindrical casing 41 made of, for example, paper. On the both ends of this casing 41 are disposed a pair of filter members 46*a* and 46*b* respectively acting as an air-permeable filler. These filter members may be made of the same filter member employed usually in the ordinary cigarette, or a filter member of low filtering efficiency. Further, in this casing 41 is disposed an elastically deformable hollow cylindrical vessel 42 made of, for example, plastic material such as polyethylene or polystyrene, which is interposed between the filter members 46*a* and 46*b* in such a manner as to leave a space between the peripheral surface of the cylindrical vessel 42 and the inner wall of the casing 41. The both open ends of this vessel 42 are sealed respectively with a seal film that can not be broken even if the vessel 42 is elastically deformed. A partition wall 43 is disposed in the vessel 42 partitioning the vessel 42 into two chambers 42*a* and 42*b*. The chamber 42*a* is filled with water 44, whereas the chamber 42*b* is filled with a substance such as quicklime 45, which is capable of reacting with water to generate heat. In the partition wall 43 is provided a thin walled portion (for example, radial V-shaped grooves, not shown), which can be broken down as the vessel 42 is elastically deformed. A flavor-generating medium sheet 47 in the form of fine strip according to the present invention is wrapped around the outer wall of the vessel 42 in such a manner as to partially overlap each other so that a space is formed between the inner wall of the casing 41 and the vessel 42 thereby to allow air to pass through the space. When the center portion of the filter unit 40A is collapsed between fingers thereby elastically deforming the vessel 42, the thin walled portion of the partition wall 43 is broken down to allow the water 44 in the chamber 42*a* to enter the chamber 42*b* and to chemically react with quicklime 45, thus generating heat (exothermic hydration). As a result, the flavor-generating medium 47 is heated by this generated heat, releasing the flavoring component. In this case, when the smoking article 40 is sucked through the rear end portion of the filter unit 40A, the ambient air entering from the cigarette cylinder 40B and taking up the flavoring component as it passes through a space between the outer peripheral wall of the vessel 42 and the inner wall of the casing 41 enters the mouth of a smoker.

Figure 5:
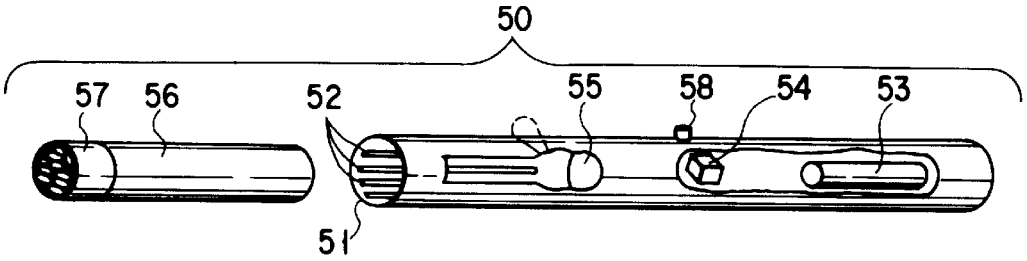
FIG. 5 is a partially cutaway and exploded perspective view schematically showing still another example of a flavor-tasting article to which the present invention may be applied.

FIG. 5 illustrates still another embodiment of a non-burning type smoking article according to the present invention. The basic structure of this non-burning type smoking article is already known in the art as disclosed in Unexamined Japanese Patent Application Publication 5-115272. Referring to FIG. 5, a smoking article 50 comprises a hollow cylindrical body 51 made of, for example, tantalum, on the inner wall of which a plurality of heating wires 52 each being bent are mounted hanging down therefrom. In order to supply an electric energy to the wire 52 for heating the wire 52, a battery 53, for example, is disposed inside the rear end portion of the cylindrical body 51. The power from the battery 53 can be controlled by means of a controlling means 54 provided for heating the flavor-generating medium as will be explained below. One end of each heating wire 52 is commonly earthed, and the other end of each heating wire 52 is individually connected to the controlling means 54. A rod-shaped flavor-generating medium 56 formed separately from the cylindrical body 51 is detachably inserted into the cylindrical body 51. This flavor-generating medium 56 contains the flavor-generating material of the present invention. When this flavor-generating medium 56 is inserted into the cylindrical body 51 through an open end where the wires 52 are mounted to such extent that the forward end portion of the flavor-generating medium 56 is contacted with the partition wall 55 disposed in the cylindrical body 51, the flavor-generating medium 56 is kept held within the cylindrical body 51 as such that the wires 52 are pierced into the flavor-generating medium 56. As a result, the flavor-generating medium 56 thus mounted is closely contacted with the heating wires 52, so that the flavor-generating medium 56 can be effectively heated by the heating wires 52 which is energized and heated by an electric energy supplied from the battery 53, thereby releasing the flavoring component. Therefore, the flavor can be tasted by puffing the smoking article 50 through the flavor-generating medium 56. A filter 57 having a low filtering efficiency may be attached to the puffing side of the flavor-generating medium 56. By the way, the supply of electric current to the heating wires 52 may be effected by operating a push button 58 mounted on the cylindrical body 51 so as to actuate the control means 54 thereby supplying electric current from the battery 53 to the heating wires 52, thus heating the wires 52.

The present invention will be further explained with reference to the following examples, which should not be construed to limit the scope of the present invention.

EXAMPLE 1

10 g of curdlan powder was dispersed into 190 g of water in a mixer at the rotational speed of 3,000 rpm and at a temperature of 24° C. To the resultant dispersion, 10 g of nicotine citrate (the content of nicotine: 39.3%) was added and mixed therein. The resultant solution was then cast over a stainless steel belt as a sheet having a thickness of 0.03 to 0.1 inch and then dried at a temperature of 107° C. By this drying, the curdlan was heat-irreversibly gelled, holding and fixing therein the nicotine citrate. Subsequently, the resultant sheet was suitably humidified and conditioned so as to adjust the water content thereof to 10 to 20% by weight, and the sheet was removed from the stainless steel belt, thus a flavor-generating material sheet of the present invention. The thickness of the sheet thus obtained was found to be 0.01 to 0.03 inch. The loss of nicotine due to the drying treatment during the manufacture of this sheet was confirmed to be less than 1% by weight by the gas chromatography, indicating that a high fixing ratio of nicotine could be realized.

As a control, puff cut tobacco containing 1% by weight or less of nicotine was sprayed with an aqueous solution of nicotine citrate so as to have the same nicotine concentration as noted above. This cut tobacco and the flavor-generating material sheet of the invention obtained above were conditioned at a temperature of 22° C. and a relative humidity of 60% for 3 days for one test and 30 days for another test. These two kinds of samples were subjected to a measurement of the nicotine concentration and an organoleptic test.

The measurement of the nicotine concentration was conducted by means of a gas chromatography.

The concentration of the nicotine added to the puff cut tobacco was found to be reduced by 5% by weight after 3 days, and by 20% by weight after 30 days. By contrast, the nicotine concentration of the flavor-generating material sheet of the present invention was found substantially unchanged, and 99% by weight or more of the nicotine was retained therein even after 30 days.

The organoleptic test was conducted as follows: 500 mg of the flavor-generating material sheet was cut into pieces, 2 mm in width, which were then placed on a metal plate and heated from below to a temperature of 300° C. The generated flavor was evaluated by three organoleptic examiners, and the evaluations were represented by four stages taking an average of the evaluations. The results of the organoleptic test are shown in Table 1 below.

TABLE 1

| | Puff cut tobacco | | Flavor-generating material sheet of invention | |
|---|---|---|---|---|
| Flavor | After 3 days | After 30 days | After 3 days | After 30 days |
| Nicotine | ○ | Δ | ◎ | ◎ |

The generation of any of substances which may interfere with the flavor of the nicotine, such as obnoxious stimulating, pungent or fibrous smelling substances was not recognized from the sheet material composed mainly of curdlan during the heating the flavor-generating material sheet of the invention.

EXAMPLE 2

10 g of curdlan powder was dispersed into 190 g of water under the same conditions as those of Example 1. To the resultant dispersion, 1 g of vanilla extract (10 g as an ethanol solution ) was added, and mixed therein. The solution obtained was treated in the same manner as in Example 1 to prepare a flavor-generating material sheet of the invention, holding and fixing therein the vanilla extract. The thickness of the sheet thus obtained was found to be 0.01 to 0.03 inch.

As a control, puff cut tobacco containing 1% by weight or less of nicotine was sprayed with an ethanol solution of vanilla extract so as to have the same vanilla extract concentration as noted above. This cut tobacco and the flavor-generating material sheet of the invention obtained above were conditioned at a temperature of 22° C. and a relative humidity of 60% for 3 days for one test and 30 days for another test. These two kinds of samples were subjected to an organoleptic test in the same manner as in Example 1. The results are shown in Table 2 below.

TABLE 2

| Flavor | Puff cut tobacco | | Flavor-generating material sheet of invention | |
|---|---|---|---|---|
| | After 3 days | After 30 days | After 3 days | After 30 days |
| Vanilla Extract | ○ | × | ◎ | ◎ |

EXAMPLE 3

10 g of curdlan powder was dispersed into 190 g of water under the same conditions as those of Example 1. To the resultant dispersion, 10 g of nicotine citrate (the content of nicotine: 39.3%) and 1 g of vanilla extract (10 g as an ethanol solution) were added and mixed therein. The solution obtained was treated in the same manner as in Example 1 to prepare a flavor-generating material sheet of the invention, holding and fixing therein the nicotine and vanilla extract. The thickness of the sheet thus obtained was found to be 0.01 to 0.03 inch.

As a control, puff cut tobacco containing 1% by weight or less of nicotine was sprayed with an aqueous solution of nicotine citrate and an ethanol solution of vanilla extract so as to have the same nicotine and vanilla extract concentrations as noted above. This cut tobacco and the flavor-generating material sheet of the invention obtained above were conditioned at a temperature of 22° C. and a relative humidity of 60% for 3 days for one test and 30 days for another test. These two kinds of samples were subjected to a measurement of the nicotine concentration and an organoleptic test in the same manner as in Example 1.

As a result, substantially the same results as those of Example 1 were obtained with respect to the nicotine concentration, indicating a remarkably high stability with time of the sheet of the invention. The results of the organoleptic tests are shown in Table 3.

TABLE 3

| Flavor | Puff cut tobacco | | Flavor-generating material sheet of invention | |
|---|---|---|---|---|
| | After 3 days | After 30 days | After 3 days | After 30 days |
| Nicotine | ○ | Δ | ◎ | ◎ |
| Vanilla Extract | ○ | × | ◎ | ◎ |

EXAMPLE 4

The flavor-generating material sheet obtained in Example 1 was finely cut into pieces, each having a width of 2 mm, which were then wrapped with an incombustible wrapping paper, and cut to produce rod-shaped products, each having a length of 30 mm (hereinafter referred to as a flavor-generating portion). A cylindrical carbonaceous combustion portion having a plurality of axial air passageways was attached to one end of the flavor-generating portion, while a filter having a low filtration efficiency was attached to the other end of the flavor-generating portion. Then, this composite was covered around its peripheral surface with an incombustible wrapping paper containing glass fibers, thus preparing a rod-shape smoking article.

When the carbonaceous combustion portion was lit and puffed, the flavor-generating portion was heated by a heated air passed through the axial air passages of the carbonaceous combustion portion, thereby allowing the flavor free from any obnoxious stimulating taste to be generated and tasted from the first puffing. It was thus confirmed that this flavor-generating portion could be satisfactorily used for a smoking article.

EXAMPLE 5

2 g of menthol and 2 g of lecithin were dissolved into 4 g of MCT to prepare a menthol-mixed solution. Meanwhile, 12 g of curdlan powder was dispersed in 288 g of water under the conditions of a stirring rotational speed of 3,000 rpm and a temperature of 25° C. To the resultant dispersion, the menthol-mixed solution was added, and the mixture was stirred for 5 minutes to prepare an emulsified dispersion. To this emulsified dispersion, 8 g of cocoa, 6 g of sorbitol (15% by weight based on the whole composition) and 6 g of glycerin (15% by weight based on the whole composition) were added, and stirred under the same conditions as above to prepare a curdlan slurry. The curdlan slurry was cast over a stainless steel belt as a sheet to a thickness of 0.5 mm to 1.0 mm and dried at 110° C. By this drying, the curdlan was heat-irreversibly gelled, holding and fixing the menthol therein. Then, the dried curdlan sheet was peeled off from the stainless steel belt, giving a flavor-generating material sheet of the present invention. The thickness of the sheet was 0.1 mm to 0.2 mm.

The flavor-generating material sheet prepared above was stored for 20 days under the conditions of 22° C. in temperature and 60% in relative humidity, and then subjected to the measurement of menthol concentration and an organoleptic test. The menthol concentration was measured by means of a gas chromatography. As a result, it was found that 95% or more of the menthol remained in the sheet even after 20 days of storage. The results of organoleptic evaluation of the sheet were almost the same as those evaluated before storage.

EXAMPLE 6

12 g of curdlan powder was dispersed into 288 g of water under the same temperature and stirring conditions as those of Example 5, and then 0.5 g of licorice extract, a hydrophilic flavoring component, was added and dispersed therein. To the dispersion, 8 g of cocoa, 6 g of sorbitol and 6 g of glycerin were added and stirred under the same conditions to obtain a curdlan slurry. The curdlan slurry was treated in the same manner as in Example 5 to prepare a flavor-generating material sheet of the invention having licorice extract retained and fixed therein.

Then, this flavor-generating sheet of the present invention was subjected to a measurement on the concentration of the flavoring component and an organoleptic test in the same manner as in Example 5 to obtain the same results as those of Example 5.

EXAMPLE 7

0.1 g of spearmint oil, a hydrophobic flavoring component, and 2 g of lecithin were dissolved into 4 g of MCT to prepare a spearmint oil-mixed solution. Meanwhile, 12 g of curdlan powder was dispersed into 288 g of water under the same temperature and stirring conditions as those in Example 5. To the dispersion, the spearmint oil-mixed solution was added, and stirred for 5 minutes to emulsify it. To the emulsified dispersion obtained, 8 g of cocoa, 6 g of sorbitol and 6 g of glycerin were added and stirred under the same conditions to prepare a curdlan slurry. The curdlan slurry was treated in the same manner as in Example 5 to prepare a flavor-generating material sheet of the invention having spearmint oil retained and fixed therein.

Then, this flavor-generating sheet of the present invention was subjected to a measurement on the concentration of the flavoring component and an organoleptic test in the same manner as in Example 5 to obtain the same results as those of Example 5.

EXAMPLE 8

A spearmint oil-mixed solution was prepared in the same manner as in Example 7. Meanwhile, 12 g of curdlan powder was dispersed into 288 g of water at the same temperature and stirring conditions as those in Example 5. To the resultant dispersion, the spearmint oil-mixed solution was added, and stirred for 5 minutes to emulsify it. To the emulsified dispersion obtained, 8 g of cocoa was added and stirred under the same conditions to prepare a curdlan slurry. Subsequently, this curdlan slurry was gradually heated under stirring to remove the water therefrom, and was gelled by raising the temperature up to 110° C. As a result, the curdlan was heat-irreversibly gelled, holding and fixing the spearmint oil therein. The gel thus obtained was vacuum-dried and pulverized with a hammer mill to prepare a powdery flavor-generating material.

This flavor-generating material was subjected to the measurement of flavor concentration and an organoleptic test in the same manner as in Example 5 to obtain the same results as those of Example 5.

EXAMPLE 9

A spearmint oil-mixed solution was prepared in the same manner as in Example 7. Meanwhile, 12 g of curdlan powder was dispersed into 288 g of water under the same temperature and stirring conditions as those in Example 5. To the resultant dispersion, the spearmint oil-mixed solution and 0.5 g of licorice were added, and stirred for 5 minutes to emulsify them. To the emulsified dispersion obtained, 8 g of cocoa, 6 g of sorbitol and 6 g of glycerin were added and stirred under the same conditions to prepare a curdlan slurry. This curdlan slurry was treated in the same manner as in Example 5 to prepare a flavor-generating material sheet of the present invention, having spearmint oil and licorice retained and fixed therein.

This flavor-generating material sheet of the invention was subjected to a measurement of the flavor concentration and an organoleptic test in the same manner as in Example 5 to obtain the same results as those of Example 5.

EXAMPLE 10

A menthol-mixed solution was prepared in the same manner as in Example 5. Meanwhile, 12 g of curdlan powder was dispersed into 288 g of water under the same temperature and stirring conditions as those in Example 5. To the resultant dispersion, the menthol-mixed solution was added and stirred for 5 minutes emulsify it. To the emulsified dispersion obtained, 4 g of sorbitol (10% by weight based on the whole composition), 8 g of glycerin (20% by weight based on the whole composition) and then 8 g of cocoa powder were added and stirred under the same conditions to prepare a curdlan slurry. This curdlan slurry was treated in the same manner as in Example 5 to prepare a flavor-generating material sheet of the present invention.

Additionally, another flavor-generating material sheet of the present invention was prepared in the same manner as mentioned above except that the amount of sorbitol was changed to 8 g (20% by weight based on the whole composition), and the amount of glycerin was changed to 4 g (10% by weight based on the whole composition).

These flavor-generating material sheets and the flavor-generating material sheet prepared in Example 5 were compared with respect to pliability thereof. As a result, it was found that when the weight ratio of sorbitol/glycerin was 10/20, the pliability of the sheet was increased so that a sheet excellent in elasticity and pliability could be obtained, and that when the weight ratio of sorbitol/glycerin was 20/10, the pliability of the sheet was decreased so that a sheet obtained was hard. Further, as a result of examination of these sheets, it was found that when the weight ratio of sorbitol/glycerin was 15/15, a sheet excellent in releasability and optimum in pliability could be obtained.

Subsequently, these flavor-generating material sheets were subjected to a measurement of the flavor concentration and an organoleptic test in the same manner as in Example 5 to obtain the same results as those of Example 5.

EXAMPLE 11

In this Example, a smoking article having a structure shown in FIG. 1 was prepared.

First, the flavor-generating sheet obtained in Example 7 was cut into pieces like cut tobacco, which was employed as a flavor-generating medium 15 to prepare a flavor-tasting article of the present invention.

As a control, puff cut tobacco was sprayed with spearmint oil so as to have the same concentration of spearmint oil as that in Example 7. The resultant puff cut tobacco was used as a flavor-generating medium 15 to prepare a flavor-tasting article as a control.

These flavor-tasting articles were lit at their carbonaceous heating sources 12 and puffed, and organoleptic evaluations were performed.

Figure 6:
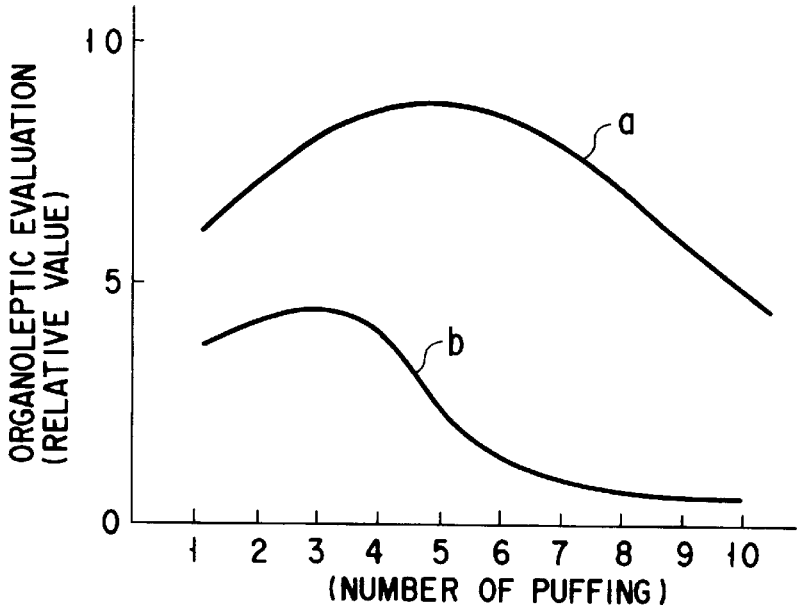
FIG. 6 is a graph showing the results of organoleptic evaluation of a flavor-tasting article of the present invention in comparison with those of a control.

As a result, it was found that in the case of the flavor-tasting article of the present invention, the flavor of spearmint was generated immediately after the puffing, and a stable generation of the flavor was substantially maintained during 10 times of puffing (see FIG. 6, curve a). Further, any substances which may interfere with the flavor of the spearmint oil, such as obnoxious stimulating, pungent or fibrous smelling substances were not generated from the sheet material composed mainly of curdlan during puffing.

On the other hand, in the case of the control flavor-tasting article wherein spearmint oil was added to puff cut tobacco, the build up in generation of the flavoring component is rather late, and the generation of the flavor was abruptly lowered after the fifth puffing (see FIG. 6, curve b).

As explained above, it is possible according to the present invention to provide a flavor-generating material which is excellent in storage stability of a flavoring component contained therein and capable of readily releasing a flavoring component when it is heated without giving off any obnoxious taste and smell. Further, it is possible to easily manufacture the flavor-generating material by a simple process. Furthermore, a flavor-tasting article containing a flavor-generating material of the invention can readily release the flavoring component upon heating from the flavor-generating material so as to satisfy the taste of a smoker through his gustatory or olfactory organs.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

We claim:

1. A flavor-tasting article substantially without accompanying smoke of tobacco filler, said article comprising:

a non-burning flavor-generating medium in a smoking article for releasing a flavoring component upon heating; and a heating source physically separated from said flavor-generating medium for heating said flavor-generating medium to release the flavoring component therefrom, said flavor-generating medium including a flavor-generating material which comprises a flavoring component-holding material comprising a heat-irreversibly gelled heat-irreversibly coagulating glucan, said glucan being at least one of β-1, 3-glucan and curdlan, and the flavoring component being held in said gelled glucan.

2. The flavor-tasting article according to claim 1, wherein the flavoring component is a hydrophilic flavoring component.

3. The flavor-tasting article according to claim 1, wherein the flavoring component comprises a hydrophobic flavoring component, and the flavor-generating material contains an oily solvent for the hydrophobic flavoring component.

4. The flavor-tasting article according to claim 3, wherein the oily solvent is a middle chain saturated fatty acid triglyceride.

5. The flavor-tasting article according to claim 3, wherein the flavor-generating material contains an emulsifying agent.

6. The flavor-tasting article according to claim 3, wherein the flavoring component further contains a hydrophilic flavoring component.

7. The flavor-tasting article according to claim 1, wherein the flavor-generating material contains a softening agent comprising a polyhydric alcohol or a saccharide.

8. The flavor-tasting article according to claim 1, wherein the gelation is carried out in the absence of a gelling agent.

9. The flavor-tasting article according to claim 1, wherein the flavor-generating medium is sheet tobacco containing said flavor-generating material.

10. The flavor-tasting article according to claim 1, wherein said flavor-generating medium is made by mixing the flavor-generating material in a cut or pulverized form and a sheet tobacco material, and molding the resultant mixture into a sheet.

11. The flavor-tasting article according to claim 1, wherein said heating source is selected from the group consisting of a carbonaceous combustible heating source, a chemical reaction heating source, and an electrical heating source.

12. A flavor-tasting article comprising:

a non-burning flavor-generating medium in a smoking article which comprises a flavor-generating material composed of a flavoring component-holding material comprising a heat-irreversibly gelled heat-irreversibly coagulating glucan, said glucan being at least one of β-1, 3-glucan and curdlan, and a flavoring component held in the holding material, said flavor-generating medium being capable of releasing the flavoring component only through heating; and a heating source which is physically separated from said flavor-generating medium, and is used for heating said flavor-generating medium to release said flavoring component therefrom, said heat source further comprising a hollow tube in which said flavor-generating medium is disposed.

13. The flavor-tasting article according to claim 12, wherein said hollow tube is a first hollow tube and wherein the flavor-tasting article further comprises a second hollow tube disposed on the inner wall of said first hollow tube, said second hollow tube is heat insulating.

14. The flavor-tasting article according to claim 13, further comprising a third hollow tube disposed on the inner wall of said second hollow tube, said flavor-generating material being disposed inside said third hollow tube, said third hollow tube is heat insulating.

15. A flavor-tasting article comprising:

a non-burning flavor-generating medium in a smoking article which comprises a flavor-generating material composed of a flavoring component-holding material comprising a heat-irreversibly gelled heat-irreversibly coagulating glucan, said glucan being at least one of β-1, 3-glucan and curdlan, and a flavoring component held in the holding material, said flavor-generating medium being capable of releasing the flavoring component only through heating; and a heating source which is physically separated from said flavor-generating medium, and is used for heating said flavor-generating medium to release said flavoring component therefrom, said heat source further comprising non-combustible means for generating heat.

16. The flavor-tasting article according to claim 15, wherein said non-combustible means is an exothermic chemical reaction.

17. The flavor-tasting article according to claim 15, wherein said non-combustible means is a battery connected to heating wires.

18. The flavor-tasting article according to claim 15, wherein the flavoring component comprises a hydrophobic flavoring component, and the flavor-generating material contains an oily solvent for the hydrophobic flavoring component, and the oily solvent is a middle chain saturated fatty acid triglyceride.

19. The flavor-tasting article according to claim 15, wherein the flavoring component comprises a hydrophobic flavoring component, and the flavor-generating material contains an oily solvent for the hydrophobic flavoring component and an emulsifying agent.

20. A flavor-tasting article substantially without accompanying smoke of tobacco filler, said article comprising:

a non-burning flavor-generating medium in a smoking article for releasing a flavoring component upon heating; and a heating source physically separated from said flavor-generating medium for heating said flavor-generating medium to release the flavoring component therefrom, said flavor-generating medium including a flavor-generating material which comprises a flavoring component-holding material comprising a heat-irreversibly gelled heat-irreversibly coagulating glucan, said glucan being at least one of β-1,3-glucan and curdlan, and the flavoring component held in said gelled glucan, said flavor-generating medium having been prepared by (1) preparing a dispersion of said glucan in water, (2) adding the flavoring component to the dispersion, (3) casting the resultant mixture into a sheet, (4) thermally gelling the case sheet to hold the flavoring component within the gelled glucan, (5) cutting or pulverizing the gelled sheet to provide the flavor-generating material, (6) admixing the flavor-generating material into a sheet tobacco raw material, (7) forming the resultant admixture into a sheet, and (8) cutting or pulverizing the formed sheet to provide the flavor-generating medium.

21. The flavor-tasting article according to claim 20, wherein the flavoring component is a hydrophilic flavoring component.

22. The flavor-tasting article according to claim 20, wherein the flavoring component comprises a hydrophobic flavoring component, and the flavor-generating material contains an oily solvent for the hydrophobic flavoring component.

23. The flavor-tasting article according to claim 22, wherein the oily solvent is a middle chain saturated fatty acid triglyceride.

24. The flavor-tasting article according to claim 22, wherein the flavor-generating material contains an emulsifying agent.

25. The flavor-tasting article according to claim 22, wherein the flavoring component further contains a hydrophilic flavoring component.

26. The flavor-tasting article according to claim 20, wherein the flavor-generating material contains a softening agent comprising a polyhydric alcohol or a saccharide.

27. The flavor-tasting article according to claim 20, wherein the gelation is carried out in the absence of a gelling agent.

28. The flavor-tasting article according to claim 20, wherein said heating source is selected from the group consisting of a carbonaceous combustible heating source, a chemical reaction heating source, and an electrical heating source.

* * * * *

UNITED STATES PATENT AND TRADEMARK OFFICE

CERTIFICATE OF CORRECTION

PATENT NO. : 5,845,649

DATED : December 8, 1998

INVENTOR(S) : Yutaka Saito; Yuriko Anzai; Ryuichi Suzuki; Hiroshi Ichinose

It is certified that error appears in the above-identified patent and that said Letters Patent is hereby corrected as shown below:

Title page, under "Related U.S. Application Data" number (63) Please correct it to read the following:

--Continuation of Ser No. 530,104, Sep. 26, 1995, abandoned, filed as PCT/JP/95/00090, Jan. 26, 1995.

Signed and Sealed this

Eleventh Day of April, 2000

*Attest:*

*Attesting Officer*

Q. TODD DICKINSON

*Director of Patents and Trademarks*